US005641182A

United States Patent [19]

Schwandt

[11] Patent Number: 5,641,182

[45] Date of Patent: Jun. 24, 1997

[54] INFORMATION RELOCATING SYSTEM

[76] Inventor: Bruce Schwandt, 24551 Del Prado, Dana Point, Calif. 92629

[21] Appl. No.: 575,094

[22] Filed: Dec. 19, 1995

[51] Int. Cl.[6] ..... B42F 21/00

[52] U.S. Cl. ..... 283/36; 283/37; 283/38

[58] Field of Search ..... 283/36, 38, 42, 283/37, 66.1, 115, 39, 40

[56] References Cited

U.S. PATENT DOCUMENTS

| | | | |
|---|---|---|---|
| 3,958,816 | 5/1976 | Remmy, III | 283/38 |
| 4,175,777 | 11/1979 | Horn | 283/42 |
| 4,235,459 | 11/1980 | Callahan | 283/7 |
| 4,978,143 | 12/1990 | Ericson | 283/38 |
| 5,011,189 | 4/1991 | Olson | 283/81 |
| 5,182,152 | 1/1993 | Ericson | 428/42 |
| 5,468,085 | 11/1995 | Kline | 283/36 X |

*Primary Examiner*—Willmon Fridie, Jr.

[57] ABSTRACT

An improved indexing apparatus with a wide range of uses which is intuitive to use, and economically manufactured using a minimum of materials and manufacturing steps. The preferred embodiment comprises a central index with an index portion and a marking portion printed on a layer of sheet stock with adhesive backing. Markers are die-cut from the same layer of sheet stock as the central index and have unique identifiers corresponding to unique identifiers on the marking portion of the central index. The markers and the central index are completely severed from each other and are held adjacent by their mutual releaseable attachment to a common backing sheet. A portion of the backing sheet is removable to allow attachment of the device to a document or other surface, the remaining portion serves to hold the markers adjacent to the central index.

17 Claims, 3 Drawing Sheets

INFORMATION RELOCATING SYSTEM

CROSS REFERENCES TO RELATED APPLICATIONS

No related patent applications have been filed by applicant. Disclosure Document #387963 titled "User-Defined Indexing System" was filed and recieved by the Patent and Trademark Office on Jul. 11, 1995.

LIST OF REFERENCE NUMERALS

28 First Layer of Sheet Stock
30 Markers
32 Central Index
34 Index Portion of Central Index
36 Marking Portion of Central Index
37 Unique Identifier
38 First Portion of Backing
40 Second Portion of Backing
42 Separating Line on Backing Sheet
44 Adhesive
46 Bottom Sheet or Backing
48 Portion of Backing Attached to Marker
50 Wire Embedded Into Marker

BACKGROUND OF THE INVENTION

The present invention relates to reference-aid devices. More particularly, this invention is an improved and economically fabricated reference-aid apparatus to be used with various types of information retrieval problems, being mountable by a user on a surface, for quickly and accurately retrieving an item of information of user-defined importance.

As the information age continues, information processing becomes a vital function. Once a piece of information is located and identified as important to the user, re-accessing that unique information at a later time becomes more and more difficult. Because information changes so rapidly and because the volume of information is so great, it is very difficult for an information user to remember which magazine or book that important information was in, let alone which page in that document held the useful information. Students constructing term papers often suffer considerable anxiety resulting from trying to re-locate important information. Magazines and catalogs tend to stack up on coffee tables or shelves, general reference books get filed away and rarely re-used. Something in that magazine stack or book was important to the user at one time, but if more than five minutes is required to re-locate it, most people simply don't bother. The problem is particularly acute if a few days pass between the "first finding" and the subsequent "need to relocate" of an information bit.

Prior to this invention, information could not be pinpointed again with sufficient speed or accuracy. Much time and inconvenience was encountered, and much mental anguish suffered resulting from attempts to re-locate information important at the moment. Sometimes the search was abandoned altogether, often resulting in the more severe consequence of poor decisions due to incomplete information.

Publishers of books and periodicals have tried to overcome this problem by creating tables of contents and indexes, but these are generic and topical by nature, since the publisher is trying to accomodate a broad audience. The user's unique information demand, on the other hand, is usually very specific and rarely matches the topic contemplated by the publisher. Oftentimes, items of interest to a particular user are not even delineated in a table of contents, one example being advertisements, another example being photographs in a design magazine. In an era of rapidly changing technology, these ads are often the most useful source of up-to-date information.

Yet another information requirement is re-locating items placed in a freezer for storage—once a container has frosted over, no one remembers what it is or how long it has been there. Another example of the same problem is when one is dismantling an machine such as an automobile for repair. Pads are often mislaid or placed back into the machine in the wrong order.

This problem of re-accessing information was partly solved by the common bookmark, but that device does not give the user any qualitative reference information about the item being marked. Bookmarks also can be moved easily, which makes them somewhat unreliable as the user may forget which piece of information was marked. Bookmarks also tend to fall out which makes them unsuitable for marking multiple references.

An improvement was made by adhering blank or colored paper or plastic tabs such as Post-It Notes, or indexing tabs onto the page of interest, but the problem persisted because people again couldn't remember which tabs were for which items, and having multiple tabs on the same reference source with no central index for notes only made matters worse. Also, the tabs themselves were rarely handy when the "need to mark" arose, so the act of marking remained somewhat inconvenient.

A variety of systems have been used to address the problem of re-accessing information. Such systems generally include a series of adhesively mountable tabs or markers having indicia such as numbers or colors and are provided together with an adhesive backed index page which can be permanently mounted in a book.

These systems all have certain drawbacks. Some of the systems require the marker to extend past the edge of the marked page, which can cause damage to either the marker or the page itself.

There are systems which fabricate both the markers and the central index portion from the same piece of sheet stock using perforated lines to allow removal of the markers from the central index portion. The weakness of this method lies in the fact that the markers or the central index portion may be torn when removing the markers, as anyone knows who has accidently torn a stamp when removing it from a sheet or a roll.

Other systems incorporate the central index portion on a separate learning key card and/or in connection with an envelope to hold the markers and/or central index portion. This method is cumbersome to use, relatively costly to manufacture, and wastes precious natural resources by using an excessive amount of material.

Some systems which incorporate tabs with adhesive on ½ of one side may not attach securely to the page and may come loose during use.

There are systems in which the central index portion extends past the edge of the publication. This feature may cause the page to tear, or the central index to tear, or both.

Other systems have markers which are restricted to being pre-printed with names of books of the bible. These systems are useful only for referencing bibles, and only with the biblical book names.

Some systems are specifically designed for manufacture simultaneously with a publication. With this method the problem of re-accessing information persists with all other documents which do not happen include the specified referencing system at time of manufacture, as well as documents which are not published at all such as legal documents but may still contain reference material valuable to the user.

The present invention addresses the foregoing problems with existing indexing systems and provides a system which is suitable for marking a variety of documents with ease and convenience, and requires a minimum of manufacturing steps and materials.

SUMMARY OF INVENTION

One object of this invention is to provide an indexing system which has a broad range of utility, is convenient, effective, intuitive and self-explanitory to use, and is manufactured economically from readily available materials using a minimum of materials and manufacturing steps.

Another object of this invention is to provide an indexing system of the foregoing nature wherein the markers may be folded closely and securely around the pages of a publication and still allow the user to identify the marker as unique.

Another object of this invention is to provide an indexing system wherein a central index and a plurality of markers are completely severed from a single sheet of substrate and held adjacent to each other by their mutual releasable attachment to a backing sheet with a means such as adhesive.

Another object of this invention is to provide an indexing system wherein learning key cards or separate envelopes to hold parts of the system are not required.

Yet another object of this invention is to provide an indexing system of the foregoing nature wherein a central indexing portion may be mounted anywhere on any surface of a publication without requiring a portion of the device to overly the edge of the publication.

Another object of this invention is to provide an indexing system wherein the idexing words and the order in which the markers are placed throughout the information base are defined by the user.

Another object of this invention is to provide an indexing system which can be either manufactured along with a publication or sold as an aftermarket device.

Another object of this invention is to provide an indexing system which is mounted on or in close proximity to the information source.

Another object of this invention is to provide an indexing system wherein the central index and adjacent markers are attached releasably to a backing sheet which is formed from a single sheet of substrate and die-cut in such a manner as to allow partial removal of the backing for attachment to a surface while the remainder of the backing serves to hold the central index and markers adjacent to each other by their mutual releasable attachment to the backing sheet.

Yet another object of this invention is to provide an indexing system wherein a central index is preprinted on a surface and markers are releasably attached to said surface adjacent to or on top of the preprinted central index.

Yet another object of this invention is to provide an indexing system wherein the markers may be either opaque or translucent.

Another object of this invention is to provide an indexing system wherein a central index is printed on a magnetic substrate for mounting on ferrous surfaces such as the front of a freezer or the fender of an automobile with markers attached to the surface thereof using a means such as magnetic attraction, said markers attached to items inside the freezer or to parts of an engine using a means such as an embedded wire or other fastening device.

To achieve the foregoing objects, the present invention provides an indexing system comprising a central index comprising a plurality of index portions and a corresponding plurality of marking portions, each one of the marking poritons having a unique identifier. A plurality of markers are aligned adjacent to the marking portions of the central index, each marker having a unique identifier corresponding to a respective marking portion on the central index. In the preferred embodiment, the central index and the markers are initially printed on the same layer of substrate, such as sheet stock coated on the back with either permanent adhesive such as that used on Avery labels, or temporary adhesive such as that used on Post-it Notes.

The markers and the central index are completely severed from each other and are held adjacent to each other by their mutual attachment to a common backing sheet. The backing sheet is also severed in a pattern around the markers in such a way as to allow a first portion of the backing to be removed, exposing the adhesive on the first layer of sheet stock for attaching the device to a document. The second portion of the backing sheet remains attached to both the markers and the central index and serves to hold them adjacent to each other during use.

In a second embodiment of the invention, the central index, including both the indexing portion and the marking portion, is pre-printed directly onto a page of a publication. The markers with adhesive on their backs are then placed on the printed page, each adjacent to its corresponding marking portion of the central index.

A third embodiment of the invention uses a central index printed on a layer of magnetic sheet stock. The central index and markers may have an adhesive coating on the back, covered by a backing sheet. Markers are formed from the same layer of magnetic sheet stock, and are printed on both sides with a unique identifier corresponding to a unique identifier on the marking portion of the central index. Markers are embedded with wire or other fastening devices, and when removed from the central index may be either attached magnetically to an item, or attached using adhesion from the coating, or by using the embedded fasteners.

BRIEF DESCRIPTION OF THE DRAWINGS

The advantages of the present invention will be better understood by considering several preferred embodiments with reference to the attached drawings in which.

DETAILED DESCRIPTION OF THE INVENTION

Figure 1:
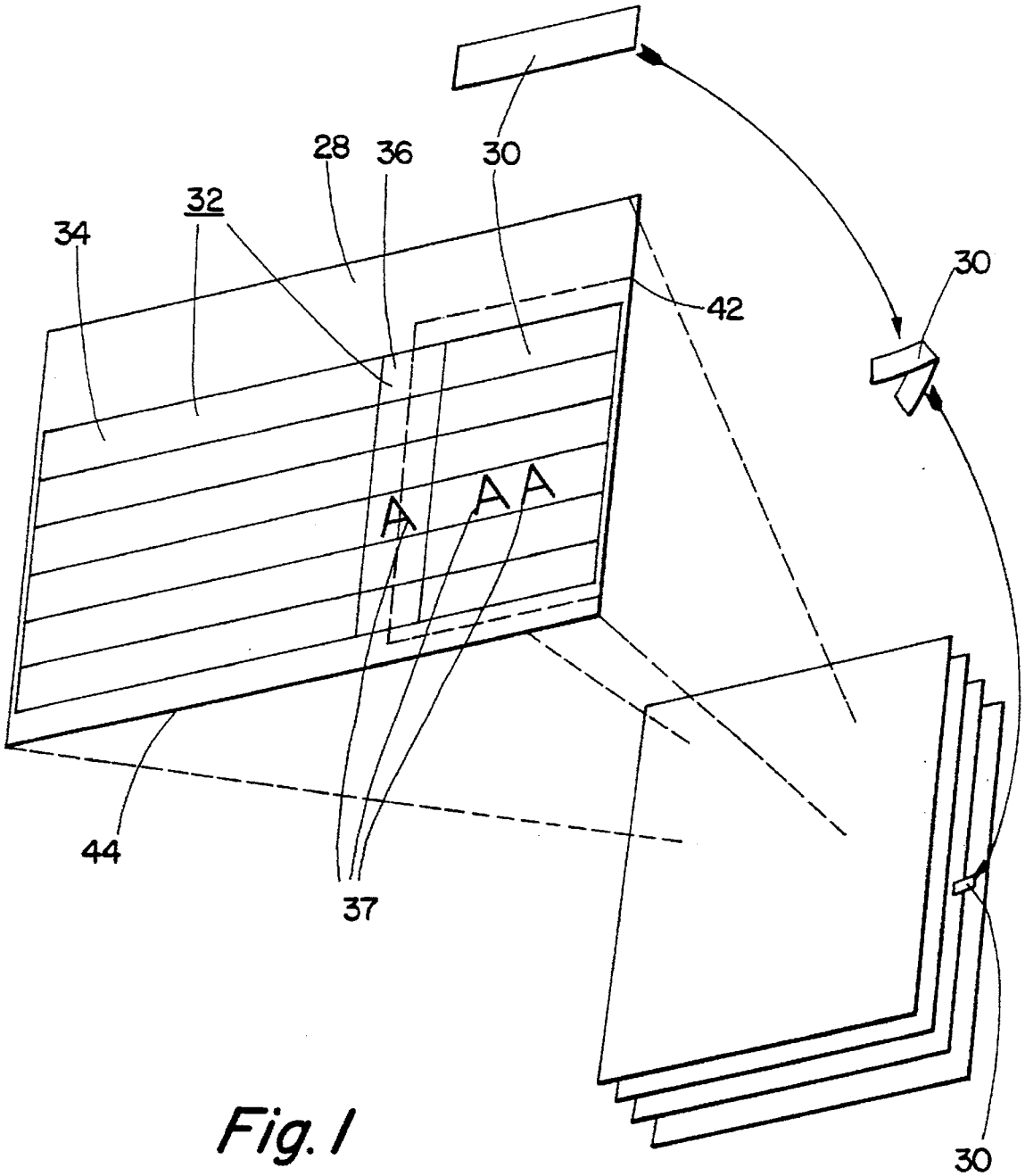
FIG. 1 is a perspective view of the preferred embodiment of the invention from the front showing placement on the document and use of the markers.
Figure 2:
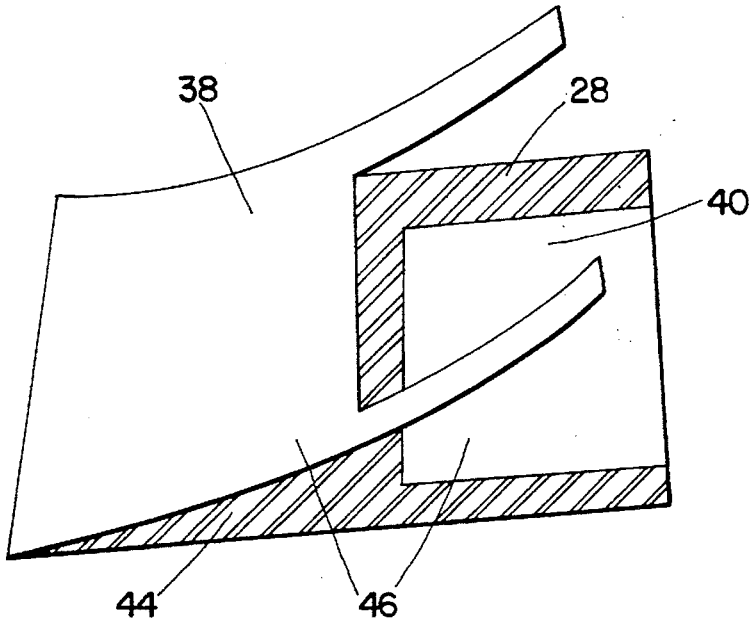
FIG. 2 is a perspective view of the preferred embodiment from the rear showing removal of the backing material, leaving the second portion of the backing to connect the markers to the central index.

FIG. 1 and FIG. 2 disclose the preferred embodiment of this invention comprising a first layer of sheet stock (28) and a bottom sheet (46) of substrate, each sheet having both a top and bottom surface. The first layer of sheet stock (28) is a thin film of flexible material such as paper, plastic, metal, or other material, the top surface of which is printed with a central index (32) comprising a indexing portion (34) and a marking portion (36), the marking portion being printed with a unique identifier (37) such as numbers, letters, colors or symbols which correspond to a plurality of markers (30), said markers (30) being die-cut from the same first layer of sheet stock (28) as that on which the central index (32) is printed and held adjacent to that index by a means. The bottom surface of the top sheet is coated with a common adhesive (44), such as that used to coat the backs of Avery labels or Post-It notes. The bottom surfaces of the markers (30) are likewise coated with adhesive (44). The bottom sheet (46) of material serves as a backing and is comprised of a thin film of material such as paper, plastic, metal or other flexible material, and may or may not be coated on its top surface with a separating medium to define a parting surface. Turning more specifically now to FIG. 2, the bottom sheet (46) comprises a first portion (38) and a second portion (40) and is completely severed with a separating line (42) in such a manner as to allow for removal of the first portion (38), leaving the second portion (40) attached to the first layer of sheet stock (28) as a means to hold the central index (32) and the markers (30) adjacent to each other.

During use in the preferred embodiment, the first portion of the bottom sheet (38) is removed and the device is placed on the document to be marked in the same manner as a label would be placed on a piece of paper, or other surface. When a page to be marked is identified, a marker (30) is removed from the device and folded around the edge of the desired page. The user may choose to leave a portion of the marker (30) extending past the edge of the page, or to fold the marker (30) closely against the page edge. The color of the marker (30) would remain visible when viewing the closed document from the side even when folded closely around the page, allowing instant cross-reference to the central index (32). A memo is made, if desired, in the index portion (34) of the central index, on the line whose marking portion (36) unique identifier (37) corresponds to the the unique identifier on the marker (30).

Figure 3:
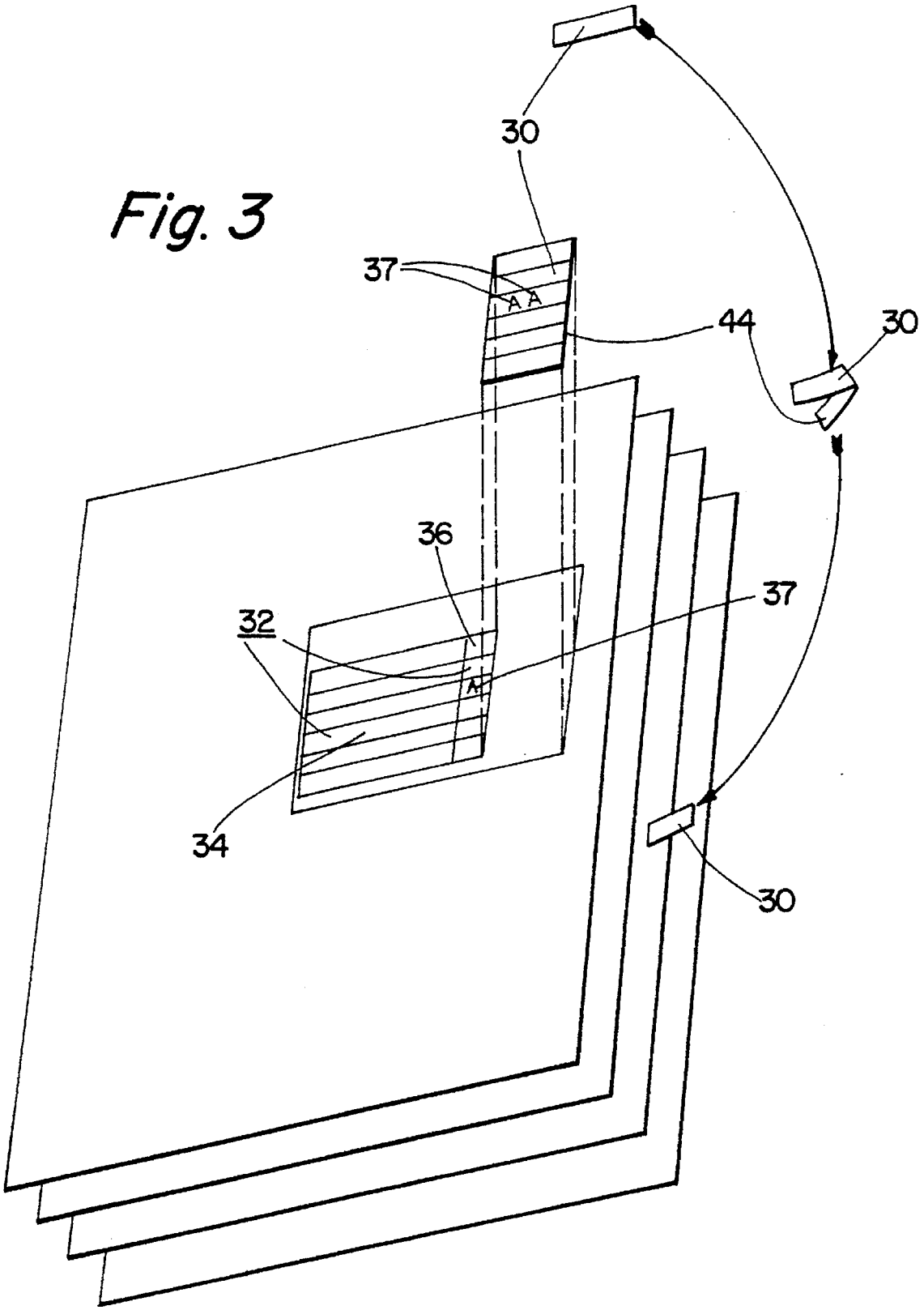
FIG. 3 is a perspective view of another preferred embodiment showing the central index preprinted onto a document and the markers placed on the document, indicating placement of the markers adjacent to the preprinted central index.

FIG. 3 discloses a second embodiment of the invention comprising a central index (32) comprising an index portion (34) and a marking portion (36) said central index (32) being preprinted onto a surface of a publication, box or other surface. The lines in the central index (32) are preferrably spaced far enough apart to allow for making handwritten notes. The marking portion (36) is printed with numbers, letters, colors or symbols or other unique identifier (37) corresponding with the same unique identifier (37) placed on a plurality of markers (30), said markers (30) being die-cut from a separate sheet of substrate than the central index (32) and releaseably attached to the surface of the publication on top of or adjacent to corresponding marking portions (36) of the central index (32) by a means such as the adhesive used on Avery labels or Post-It Notes.

When using the second embodiment the markers (30) are peeled off the surface preprinted with the central index (32) as pages to be marked are identified. Notations can be made on the indexing portion (34) of the central index (32) corresponding to the marker removed.

Figure 4:
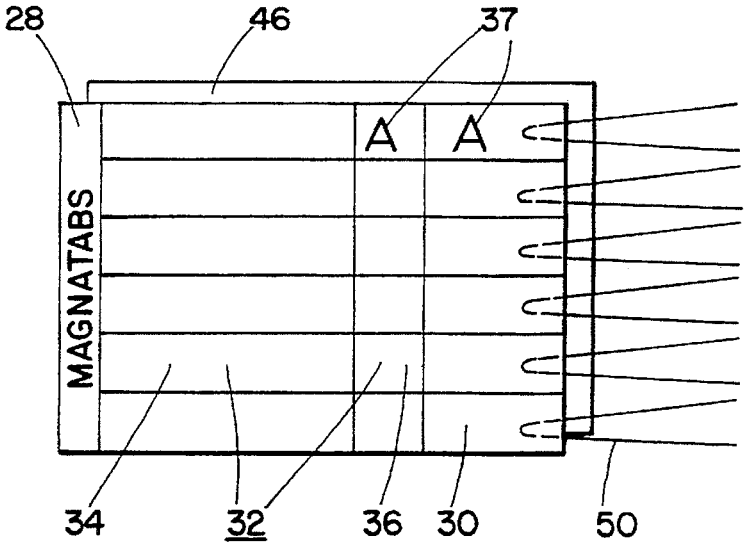
FIG. 4 is a perspective view of yet another preferred embodiment showing the central index and markers printed on a magnetic substrate.
Figure 5:
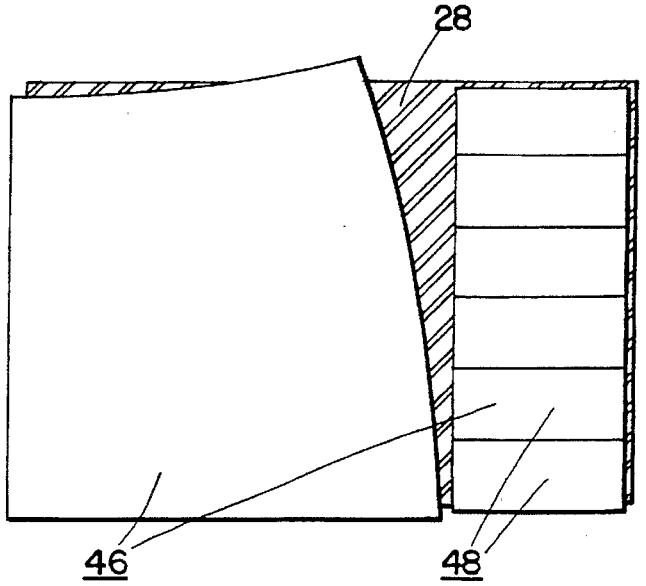
FIG. 5 is a perspective view showing the removal of a portion of the backing covering the central index while the backing remains attached to the markers.

FIG. 4 and FIG. 5 disclose a third embodiment comprising a central index (32), with an index portion (34) and a marking portion (36) printed on a first layer of sheet stock (28) comprised of a flexible magnetic material which can be attached magnetically to a metal or painted metal surface such as a refrigerator door, or automobile fender. An example of this kind of stock is the flexible refrigerator magnets commonly used in advertising. The back side of the first layer of sheet stock may be coated with a common adhesive such as that used on Scotch Tape or Post-it Notes. The markers (30) are die-cut from the same piece of sheet stock (28) as the central index (32), and may be held adjacent to the central index (32) by releasable attachment to the common backing sheet (46) or may be placed on top of the central index (32) and held by magnetic attraction. The markers (30) may be printed with a unique identifier (37) on either one or two sides. The markers (30) are embedded with wire (50) which protrudes past the edge of the marker (30) with sufficient length to be attached to an automobile part or an item in a freezer. FIG. 5 shows how the backing sheet (46), if used, is perforated in a manner so as to allow individual removal of each marker (30) with its own portion of the backing (48).

In use, the device is placed on a ferrous surface such as a refrigerator door or automobile fender and is held by magnetic attraction. Alternatively, the markers (30) and a portion of the backing sheet (46) may be removed from the central index (32). Portions of the backing (48) remain attached to the markers (30) which are held to the central index (32) by magnetic attraction. When an item is to be marked, a marker (30) is removed by tearing along the perforated lines in the backing sheet (46). The marker (30) is then attached to the item by either means of the embedded wire (50), by magnetic attraction, by removing the backing (48) from the marker (30) and adhering it to the item, or by some combination of these means. An erasable pen or a grease pencil may be used with the device for making notations on the central index (32) or the markers (30).

In conclusion, the present invention provides an indexing system which has a variety of uses, is easy and intuitive to use, and economical to manufacture using a minimum of materials and manufacturing steps.

While the above description contains many specifications, these should not be construed as limitations on the scope of the invention, but rather as an exemplification of three embodiments thereof. Many other variations are possible. For example, a preferred embodiment may comprise a central index and markers printed on a magnetic substrate as in the third preferred embodiment above, but without an adhesive coating on the back of the first layer of sheet stock, and without backing material. The markers with their embedded wires are held to the central index by magnetic attraction and are removed as needed for marking.

What is claimed is:

1. An indexing system, comprising:

a first layer of sheet stock formed on a substrate with a releasable adhesive, such that once removed from the substrate, the first layer of sheet stock may be adhered to another surface, the first layer of sheet stock comprising;

a central index having a plurality of index portions and a corresponding plurality of marking portions, each one of the marking portions having a unique identifier; and, a plurality of markers, each one of the plurality of markers corresponding to a respective marking portion of the central index and having the unique identifier associated with the corresponding marking portion;

wherein each one of the plurality of markers is removable from the first layer of sheet stock.

2. The indexing system of claim 1, wherein each unique identifier associated with a corresponding marking portion is a letter.

3. The indexing system of claim 1, wherein each unique identifier associated with a corresponding marking portion is a number.

4. The indexing system of claim 1, wherein each unique identifier associated with a corresponding marking portion is a color.

5. The indexing system of claim 1, wherein each unique identifier associated with a corresponding marking portion is a symbol.

6. The indexing system of claim 1, wherein the substrate comprises a die-cut backing sheet.

7. The indexing system of claim 6, wherein the die-cut backing sheet further comprises;

a first portion principally underlying the central index, and a second portion principally underlying the plurality of makers, the first and second portions of the due-cut backing sheet being separable one from another, such that the second portion remains under the plurality of markers upon removal of the first portion of the die-cut backing system from the first layer of sheet stock.

8. An indexing system integral to a publication, comprising:

a central index printed on a page of the publication having a plurality of index portions and a corresponding plurality of marking portion, each one of the marking portions having a unique identifier, and a plurality of markers, each one of the plurality of markers corresponding to a respective marking portion of the central index and having the unique identifier associated with the corresponding marking portion;

wherein each one of the plurality of markers is releasably attached to the same page of the publication as the central index, and is removable therefrom.

9. The indexing system of claim 8, wherein the markers are formed with a releasable adhesive, such that once removed from the publication, the markers may be adhered to another surface.

10. The indexing system of claim 8, wherein each unique identifier associated with a corresponding marking portion is a letter.

11. The indexing system of claim 8, wherein each unique identifier associated with a corresponding marking portion is a number.

12. The indexing system of claim 8, wherein each unique identifier associated with a corresponding marking portion is a color.

13. The indexing system of claim 8, wherein each unique identifier associated with a corresponding marking portion is a symbol.

14. An indexing system, comprising:

a first layer of magnetic sheet stock formed on a substrate with a releasable adhesive, such that once removed from the substrate, the first layer of magnetic sheet stock may be adhered to another surface, the first layer of stock comprising:

a central index having a plurality of index portions and a corresponding plurality of marking portions, each one of the marking portions having a unique identifier; and, a plurality of markers, each one of the plurality of markers corresponding to a respective marking portion of the central index and having the unique identifier associated with the corresponding marking portion;

wherein each one of the plurality of markers is removable from the first layer of magnetic sheet stock, and may be attached again to the first layer of sheet stock using magnetic means.

15. The indexing system of claim 14, wherein each unique identifier associated with a corresponding marking portion is a number.

16. The indexing system of claim 14, wherein each unique identifier associated with a corresponding marking portion is a color.

17. The indexing system of claim 14, wherein each unique identifier associated with a corresponding marking portion is a symbol.

* * * * *